US005320085A

United States Patent [19]

Hanneman

[11] Patent Number: 5,320,085

[45] Date of Patent: Jun. 14, 1994

[54] BOW STABILIZING ARM

[76] Inventor: Richard Hanneman, P.O. Box 493062, Redding, Calif. 96049-3062

[21] Appl. No.: 981,180

[22] Filed: Nov. 24, 1992

[51] Int. Cl.[5] ..... F41B 5/20; F41B 5/14

[52] U.S. Cl. ..... 124/89; 124/86

[58] Field of Search ..... 124/23.1, 24.1, 25.6, 124/86, 88, 89

[56] References Cited

U.S. PATENT DOCUMENTS

| | | | |
|---|---|---|---|
| 3,599,621 | 8/1971 | Scrobell | 124/23.1 |
| 3,667,444 | 6/1972 | Depatie et al. | 124/88 X |
| 4,054,121 | 10/1977 | Hoyt | 124/89 |
| 4,491,123 | 1/1985 | Wirtz | 124/89 |
| 4,674,472 | 6/1987 | Reis | 124/89 |

*Primary Examiner*—Randolph A. Reese
*Assistant Examiner*—John Ricci

[57] ABSTRACT

A portable accessory for attachment to an archer's bow to provide stability while aiming, shooting and setting bow sights. An all-thread rod [G] screwed into the hand grip [T] of the bow has a device [M, L, K, J and H] for rotating an adjustable shaft [S] on a plane parallel to the plane of the hand grip and bow string. The shaft is composed of 2 tubes [A1 and A2] of differing diameters, adjustable in length by telescoping in and out and is locked in a selected position with a thumb screw [B]. The shaft has a brace [D] attached to the end farthest from the hand grip. The brace also rotates and may rest on the archer's body, on the ground or on an overhead object such as a tree branch.

2 Claims, 2 Drawing Sheets

BOW STABILIZING ARM

BACKGROUND

1. Field of Invention

This invention relates to an archery bow, and more particularly to an adjustable arm to steady the bow during use, to aid in setting sight pins and bow sights and to enable the archer to maintain a full draw for longer periods of time.

2. Description of Prior Art

In the sport of archery, it is necessary for the archer to hold the bow steady during aiming and release of an arrow and while setting sight pins and bow sights. In hunting, it is necessary for the archer to maintain a full draw while tracking the prey. In recent years, very elaborate bow have been designed, some having compound strings and aiming devices attached thereto. Such bows are relatively heavy and are difficult for the archer to maintain steady. Various devices, such as counterweights and the like, have been proposed to assist the archer.

For example, Reis in U.S. Pat. No. 4,674,472 shows a hip rest consisting of a fixed rod capable of extension through a turn buckle type mechanism. Leidy, U.S. Pat. No. 3,880,136 discloses a steady rest that attaches to the hand and wrist of the archer and includes a member which contacts the archer's jaw. In U.S. Pat. No. 4,290,407 to Damron, a combination guide tube and chin/jaw bone butt is taught. U.S. Pat. No. 3,667,444 to Depatie et al. shows a brace for positioning a bow. U.S. Pat. No. 4,491,123 to Wirtz and U.S. Pat. No. 3,599,621 to Serobell show stabilizers rotatable in the bow plan. However, none of these prior art devices are capable of attaching to the pre-drilled threaded taps found on most better bows, permit a quick and easy extension with a thumb screw, allow for swivel motion to adjust to the archer's body, or allow for bracing on the ground or on an overhead object such as a tree. Thus there is a need for a device which will easily attach to the bow, provide the archer with more comfort, permit a quick and easy extension, permit bracing on the ground or overhead, and be easily removed without damage to the bow.

OBJECTS AND ADVANTAGES

Accordingly, several objects and advantages of the invention are:

(a) to provide a stabilizing arm that easily attaches to the pre-drilled threaded taps found on most better bows;

(b) to provide more comfort to the archer due to the greater flexibility of motion in the stabilizing arm;

(c) to provide a quick and easy method for increasing or decreasing the length of the stabilizing arm;

(d) to provide a stabilizing arm which can brace on the archer's hip, thigh, leg, or on the ground, or overhead;

(e) to provide a convenient method of stabilizing a bow for longer periods of time; and (f) to provide a method of stabilizing a bow using fewer muscles of the archer.

Further objects and advantages of the invention will become apparent from a consideration of the drawings and ensuing description.

BRIEF DESCRIPTION OF THE DRAWING FIGURES

LIST OF REFERENCE LETTERS

Figure 1:
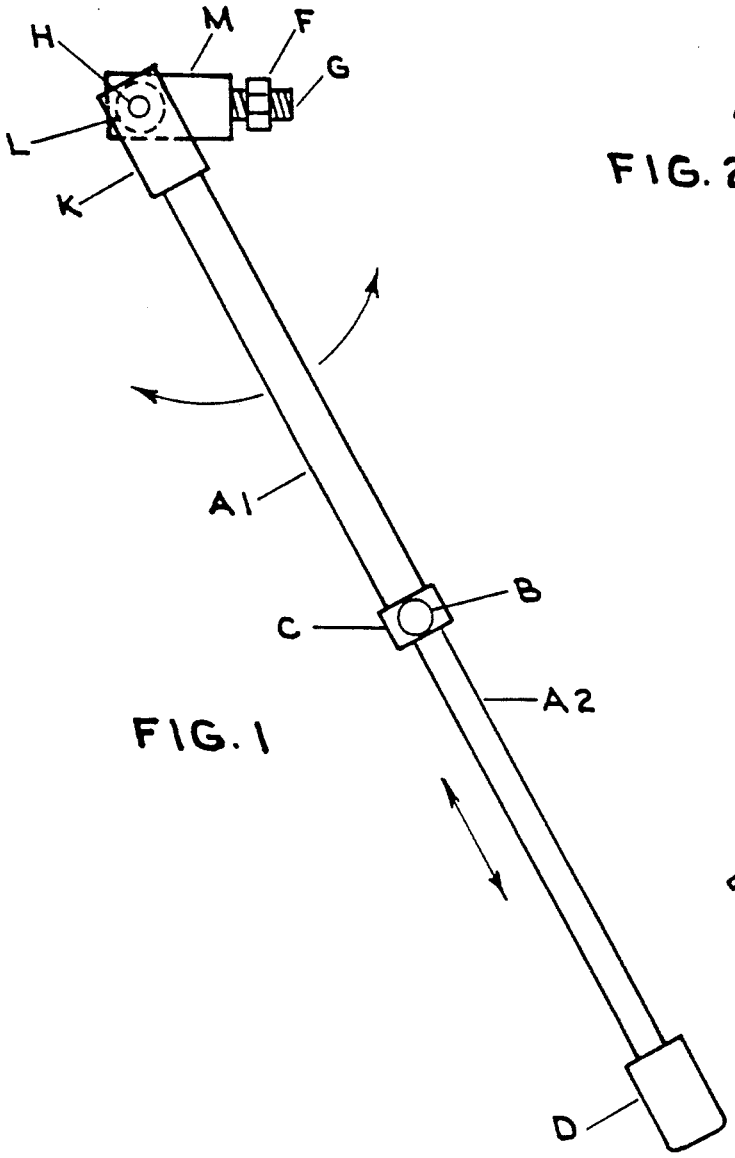
FIG. 1 is a side view of the invention.
Figure 2:
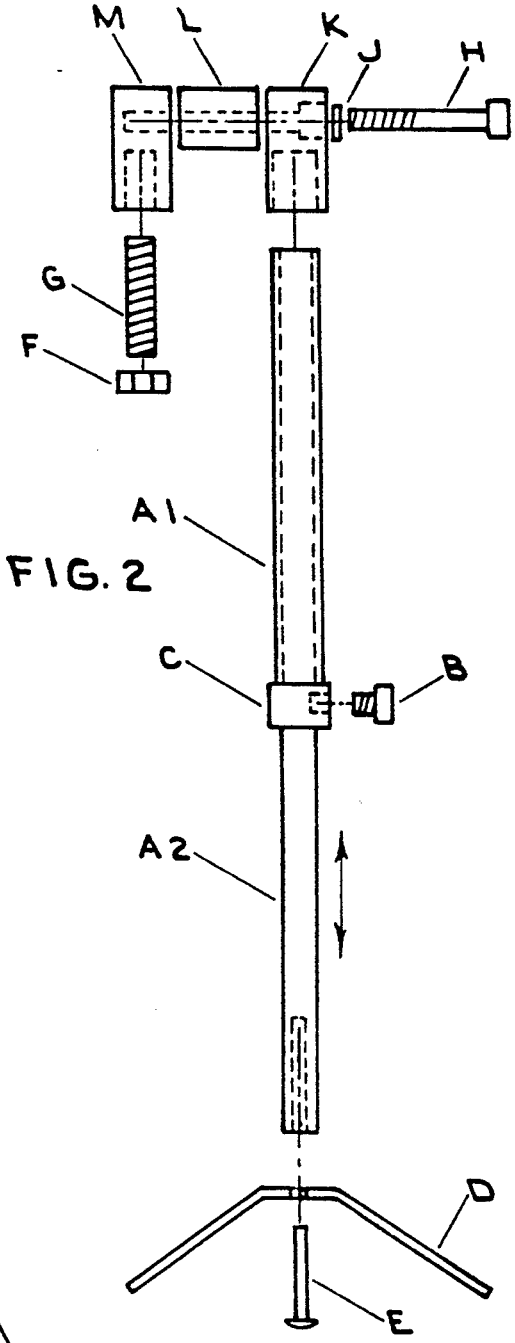
FIG. 2 is a top view of the invention.
Figure 3:
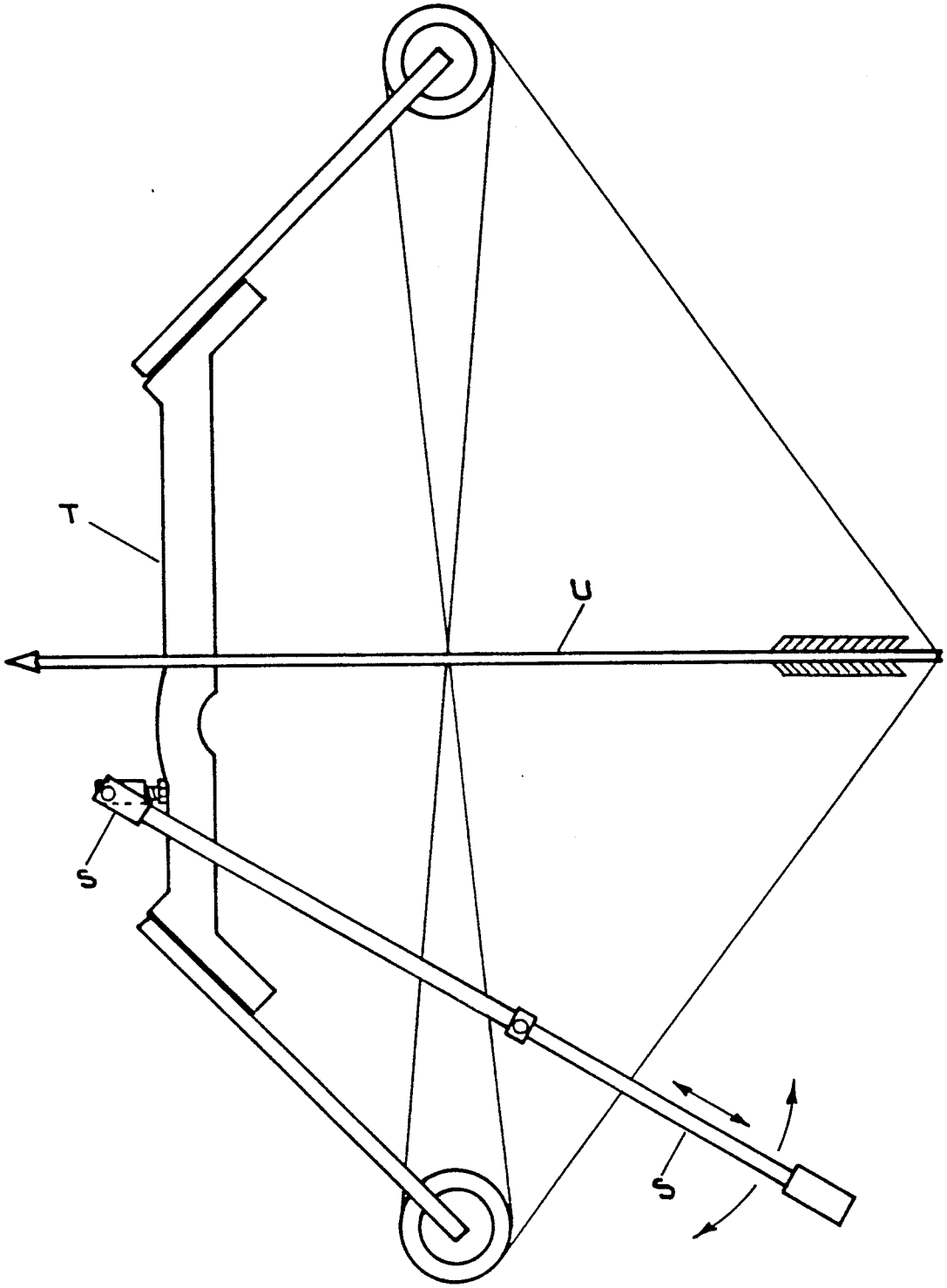
FIG. 3 is a side view of a typical bow having the invention installed thereon.

A1=outer hollow metal tube
A2=inner hollow metal tube
B=set screw
C=ring
D=brace
E=carriage bolt
F=lock nut
G=all-thread rod
H=socket head cap screw
J=lock washer
K=outside metal block
L=metal spacing tube
M=inside metal block
S=adjustable stabilizing arm
T=bow
U=arrow

SUMMARY OF THE INVENTION

The adjustable stabilizing arm is a portable accessory to an archer's bow. It is used to steady the bow while shooting long and short distances to achieve greater accuracy, enable the archer to maintain a full draw for longer periods of time, and as an aid to setting bow sights. The stabilizing arm attaches to the bow, has a rotating mechanism, has a shaft which is adjustable to rest on the archer's hip, thigh, leg or foot, or may also be used to stabilize the bow to the ground or on an overhead object.

DESCRIPTION OF INVENTION

More specifically, most better bows have a pre-drilled 5/16" diameter, 24 threads per inch threaded tap on the front edge of the bow below the hand grip. A first 1.5"×¾"×¾" aluminum block M is attached to the bow by means of a 1.5" long 5/16"×24 threads/inch all-thread rod G. The all-thread rod is screwed into a 5/16" threaded hole bored into the ¾"×¾" end of the aluminum block and also into the pre-drilled threaded tap on the bow. A 5/16" nut F in the middle of the threaded rod is used to lock the aluminum block to the bow in order to prevent movement. This block is stationary.

A second 1.5"×¾"×¾" aluminum block K is used to hold the stabilizing arm S. A ½" diameter hole, is drilled ¾" into one ¾"×¾" end of this second aluminum block. The stabilizing arm is glued into this hole.

The two aluminum blocks are attached by means of a ¾" diameter round aluminum spacing tube L, 1" long, drilled ¼" through the center of the round ends. This spacer is placed between the two blocks at the end of the first aluminum block M farthest from the bow and at the end of the second aluminum block K farthest from the hole into which the stabilizing arm is glued. It is secured by a ¼"×28 threads/inch by 1.75" long socket head cap screw H countersunk into a ¼" diameter hole bored through the opposite end of the second block and tapped into the end of the first block furthest from the bow. The socket head tap screw also has a lock washer J at the head. This enables the second block (with the adjustable arm) to rotate up and down.

The stabilizing arm S consists of an outer 18" hollow aluminum tube A1 (½" outside diameter) and an inner 20" hollow aluminum tube A2 (⅜" outside diameter) which slides in and out of the larger tube. The telescoping arm is adjustable from 20" to 35" long. The length of the stabilizing arm is fixed by a ¼" threaded thumb screw B which screws perpendicular into a ring C at the end of the outer tube farthest from the second block described above into the inner telescoping tube. This set screw is finger tightened by a ¼" thread×½" serrated thumb screw.

At the end of the telescoping rod is a 5"×¾"×⅛" aluminum strap D which is bent into a curved brace. The flat side of brace is drilled in the center and attached to the inner telescoping tube by gluing a ¼"×1.25" long carriage bolt E through the brace into the end of the inner telescoping tube. The brace can also rotate with the inner telescoping tube and be locked into the desired rotation with the threaded thumb screw B.

OPERATION OF INVENTION

The adjustable stabilizing arm is a portable accessory used to steady a bow while being used by an archer. This enables the archer to (1) achieve greater accuracy while shooting, (2) hold a full draw on the bow for a longer period of time before muscle fatigue, and (3) set the bow sights more easily.

The stabilizing arm is constructed to attach to existing threaded taps located on the front edge of most better bows by means of an all-thread rod. The arm adjusts its position up and down by rotating at the bow hand grip end. The arm also adjusts its length by telescoping in and out. The telescoping tubes are easily set by a thumb screw. The stabilizing arm may be adjusted to rest on either the archer's hip, thigh, leg or foot, on the ground, or on an overhead object. The brace at the end of the arm may be rotated to adjust to the archer's body or the topography of the ground or an overhead object.

SUMMARY, RAMIFICATIONS AND SCOPE

Accordingly, the reader will see that the bow stabilizing arm is a portable accessory that can be easily attached to an archer's bow to steady same, that can be easily adjusted to fit the archer's body or field conditions, and can be removed from the bow just as easily without damage to the bow. The adjustable features are easy to use by hand and with tools normally carried by archers. The arm is adjustable in three ways: (1) by rotating at the bow end, (2) by telescoping in length, and (3) by rotating the brace at the outer end.

Although the description above contains many specificities, these should not be construed as limiting the scope of the invention but as merely providing illustrations of some of the presently preferred embodiments of this invention. For example, the inner telescoping tube could be a solid rod or the shape of the swiveling blocks could be cylinders.

Although the preferred embodiment utilizes metal such as aluminum or steel, it is clear that modern plastics are available from which the device can be constructed. Similarly, the design of the brace can be varied to suit the individual.

Thus the scope of the invention should be determined by the appended claims and their legal equivalents, rather than by the examples given.

I claim:

1. A stabilizing arm for attachment to an archer's bow, said bow having a hand grip and bow string, comprising:

(a) an all-thread rod with a lock nut for attaching said stabilizing arm to said bow below said hand grip;

(b) a rotating means having:

(i) a stationary block attached to said all-thread rod;

(ii) a rotating block attached to an adjustable shaft;

(iii) an attachment means for attaching the stationary block to the rotating block, said attachment means having a spacing tube with a socket head cap screw going through said rotating block and spacing tube into said stationary block;

(iv) a locking means for locking said rotating block in a selected position, said locking means having said socket cap screw and a lock washer;

(c) said adjustable shaft having a first end connected to said rotating block and a second end connected to a brace for resting upon the archer's body or on the ground or on an overhead object, said adjustable shaft having (i) an outer tube having a first end connected to said rotating block and a second end open;

(ii) an inner tube having a first end telescoping into said outer tube, said inner tube and inner tube adjusting the length and rotation of said shaft, and a second end connected to said brace;

(iii) a thumb screw for locking said first and second sections in a selected length and rotation; and (d) said brace connected to the inner tube, said brace being able to rotate and lock when the inner tube rotates and locks inside said outer tube.

2. The bow stabilizing arm as recited in claim 1 in which said attachment means is a bracket connected to said rotating means and attachable to said hand grip by screws.

* * * * *